US005653804A

United States Patent [19]

Yasoshima

[11] Patent Number: 5,653,804

[45] Date of Patent: Aug. 5, 1997

[54] METHOD OF STAMPING EXPANDABLE STAMP PAD

[75] Inventor: Ryo Yasoshima, Tokyo, Japan

[73] Assignee: Tsukineko, Inc., Redmond, Wash.

[21] Appl. No.: 472,258

[22] Filed: Jun. 7, 1995

[51] Int. Cl.[6] ..... B41K 1/54

[52] U.S. Cl. ..... 118/46; 118/264; 118/269; 118/270; 101/171; 101/327; 101/333; 101/334; 33/622

[58] Field of Search ..... 101/171, 327, 101/333, 334, 405; 33/622; 118/46, 264, 269, 270

[56] References Cited

U.S. PATENT DOCUMENTS

| | | | |
|---|---|---|---|
| D. 184,720 | 3/1959 | Fleming | D18/18 |
| D. 247,063 | 1/1978 | Funahashi | D64/10 |
| D. 252,935 | 9/1979 | Henkels | D19/77 |
| D. 331,418 | 12/1992 | Winston | D18/15 |
| D. 345,826 | 4/1994 | Byars et al. | D28/83 |
| D. 347,089 | 5/1994 | Byars et al. | D28/83 |
| 602,061 | 4/1898 | Echelberger | 118/264 |
| 848,063 | 3/1907 | Sommer | 118/264 |
| 1,173,092 | 2/1916 | Bickerton | 118/270 |
| 1,463,718 | 7/1923 | Munson | 118/264 |
| 1,598,538 | 8/1926 | Mann | 118/269 |
| 1,796,137 | 3/1931 | Baumgarten | 118/264 |
| 2,117,470 | 5/1938 | Zareko | 118/264 |
| 2,290,488 | 7/1942 | Munson | 118/264 |
| 2,374,198 | 4/1945 | Harris | 118/270 |
| 2,422,814 | 6/1947 | Alexander | 118/270 |
| 2,723,476 | 11/1955 | Lyon | 15/104.72 |
| 3,326,180 | 6/1967 | Lofgren | 118/264 |
| 3,478,682 | 11/1969 | Funahashi | 101/327 |
| 3,590,734 | 7/1971 | Carter | 101/333 |
| 4,029,011 | 6/1977 | Kurner | 101/330 |
| 4,986,175 | 1/1991 | Boehringer et al. | 101/125 |

FOREIGN PATENT DOCUMENTS

| | | | |
|---|---|---|---|
| 546609 | 9/1957 | Canada | 101/333 |
| 167 380 A | 1/1986 | European Pat. Off. . | |
| 2675740 A1 | 10/1992 | France . | |
| 662905 | 6/1938 | Germany . | |
| 4-31288 A | 11/1992 | Japan . | |
| 4940 | of 1896 | United Kingdom | 118/264 |
| 2045687 | 11/1980 | United Kingdom . | |

OTHER PUBLICATIONS

Rubber stamp catalog, Clearsnap, Inc., 1990.
Tsukineko, Color Palette Pigment Stamp Pad Catalog, Japanese language document.
Tsukineko, Japanese Catalog, 1993.
Clearsnap, Color Box Pigment Stamp Pads, See circled stamp pad, top left, 1993.
Ink–A–Dink–A–Do, *4 Inks in Ones,* Stamp Pad.

*Primary Examiner*—Harold Pyon
*Attorney, Agent, or Firm*—Seed and Berry LLP

[57] ABSTRACT

An expandable stamp pad comprising a plurality of ink pads arranged in a line and suitable for use with a multitude of different aqueous dye-based inks, and methods of using the same. Typically, the line is straight, although, if desired, the line may be curved. The plurality of ink pads are retained on an extension member that permits adjacent ink pads to contact one another when the extension member is retracted, (e.g., in use) while maintaining the plurality of ink pads in separation when the extension member is extended (e.g., in storage). Also, a multi-color stamp pad suitable for use with aqueous dye-based inks wherein a plurality of ink pads each impregnated with a different ink have disposed therebetween a thin, aqueous-impermeable film, such as a thin plastic film. Preferably, the stamp pad comprises more than two ink pads, further preferably five or more ink pads.

3 Claims, 7 Drawing Sheets

METHOD OF STAMPING EXPANDABLE STAMP PAD

CROSS REFERENCE TO RELATED APPLICATION

This application is a continuation-in-part of U.S. patent application Ser. No. 08/446,205, filed on May 19, 1995.

TECHNICAL FIELD

The field of the present invention is stamp pads, and more particularly stamp pads comprising multiple inks.

BACKGROUND OF THE INVENTION

Stamps and stamp pads have been commonly used to easily transfer and reproduce letters, symbols, and graphics by imprinting. Stamps pads typically consist of a single color, such as black, blue, or red, and are primarily used for office applications.

In contrast to such single-color stamp pads, multi-color stamp pads comprising a number of ink pads with different colors arranged in a line have become commercially available in recent years. FIG. 11 depicts a schematic cross-sectional view of such a conventional multi-color stamp pad. As shown in FIG. 11, the conventional multi-color stamp pad comprises a depression 22 formed in base 21. The depression 22 has adhered thereto in a line a plurality of colored ink pads 23. The ink pads 23 each comprise a different color. The ink pads 23 are made by absorbing liquid pigment-based inks of a certain viscosity and thixotropy into sponges 20. The ink pads 23 are typically fastened so that their tops protrude from the base 21. The ink pads 23 arc covered by a lid 24. In addition, a groove 25 is typically formed around the base 21 so that the perimeter of the lid 24 can be inserted into the groove 25, thereby closing the lid on the base in an easily attachable and detachable manner.

The multi-color stamp pad is then used to transfer the multitude of inks to a rubber stamp in a rainbow of colors, which colors can then be transferred to an appropriate substrate, such as paper, to provide an imprinted image consisting of a variety of different colors.

The conventional multicolor stamp pads are limited, however, to certain liquid pigment-based inks because such inks will not disperse from one ink pad to another even if adjacent ink pads touch each other directly, so the differently colored inks do not mix together. Thus, sharp lines are maintained between the inks, and there is no concern with the creation of undesirable colors at the junction of adjacent pads, even if the pads are in actual contact.

The use of aqueous dye-based inks in such conventional multi-color stamp pads has been problematic because such inks Will disperse from one ink pad to another when adjacent ink pads are in contact with one another. As time passes, the movement of the ink between ink pads causes the colors of the ink pads to change. As a result, the original colors cannot be maintained. Additionally, unattractive color combinations may result at the junctions between the ink pads.

In the past, when such aqueous dye-based inks were used in a single stamp pad, the adjacent ink pads were separated from each other by various methods. For example, as shown in FIG. 12, the individual ink pads 23 of the multi-colored stamp pad were partitioned by a plastic partitioning plate 26. The plastic partitioning plate prevented the inks from mixing with each other. When the ink pads were to be used, the plastic partitioning plate would be removed. With this method, however, removing the plastic partitioning plate was bothersome, requiring careful manipulation by the fingers of the user, and also created a possibility of smearing ink from the plate onto a non-desired surface, such as clothing. In addition, after the plastic partitioning plate was removed, spaces remained between the colored ink pads. This was problematic because no ink (and therefore no color) was then applied at these spaces to a rubber stamp applied to the pad, and therefore the image imprinted by the rubber stamp had incomplete areas.

In an alternative previous approach, conventional multi-color stamp pads incorporating aqueous dye-based inks having two colors placed the differently colored ink pads in small separate containers. The two separate containers were housed in a stamp pad base, and the individual colored ink pads were partitioned from each other by the walls of the containers. This method was problematic, however, because multi-color stamp images could not be imprinted to the paper because the partitioning walls of the small containers projected above the surface of the ink pads, thereby preventing the stamp from simultaneously contacting two differently colored ink pads. Additionally, only a small number of colored ink pads (i.e., two) were housed in the stamp holder.

Accordingly, there has gone unmet a need for a stamp pad permitting the use of multiple, preferably more than two, aqueous dye-based inks of different colors. Further, there has gone unmet a need for such a pad comprising multiple aqueous dye-based inks wherein the ink does not disperse from one area of the stamp pad to another, and therefore wherein the inks of the stamp pad are maintained in a desired, sharply defined area. There has also gone unmet a need for a stamp pad permitting the use of multiple aqueous dye-based inks wherein upon transferring ink from the stamp pad to the rubber stamp (and later to an appropriate substrate such as paper, the ink is applied to all desired surfaces of the rubber stamp, with no "uninked" areas between the various colors.

In addition, there has gone unmet a need for a multi-color stamp pad that, when not in use, does not permit dispersion of the differently colored inks from one area to another within the pad. The present invention provides these and other related advantages.

SUMMARY OF THE INVENTION

The present invention provides a stamp pad comprising a plurality of ink pads arranged in a line and suitable for use with a multitude of different aqueous dye-based inks. Typically, the line is straight, although, if desired, the line may be curved. The plurality of ink pads are retained on an extension member that permits adjacent ink pads to contact one another when the extension member is retracted, (e.g., in use) while maintaining the plurality of ink pads in separation when the extension member is extended (e.g., in storage). The present invention also provides a multi-color stamp pad suitable for use with aqueous dye-based inks wherein a plurality of ink pads each impregnated with a different ink have disposed therebetween a thin, aqueous-impermeable film, such as a thin plastic film. Preferably, the stamp pad comprises more than two ink pads, further preferably five or more ink pads. (See Japanese Patent Application No. PWY 6003, filed Dec. 29, 1994, which is incorporated herein by reference in its entirety.)

Thus, in one aspect, the present invention provides an expandable stamp pad comprising a plurality of ink pads disposed in a line on an extension member such that the ink pad contact one another when the extension member is retracted and do not contact one another when the extension member is extended.

In a preferred embodiment, each of the ink pads has absorbed therein a differently colored ink. In other preferred embodiments, the extension member comprises a rubber plate, or an N-shaped spring substrate comprising a plurality of ink pad areas upon which are disposed the ink pads, the substrate further comprising a first cut in a region between two of the ink pad areas, the cut extending into the region from a rear edge of the spring substrate, and a second cut in the interpad area, the second cut substantially parallel to the first cut and extending from a second edge of the spring substrate. Alternatively, the extension member comprises one or more rubber bands or extensible fiber strings, the rubber band or fiber string linking together the plurality of ink pads, or an extendible and retractable plastic film, or a spring.

In another preferred embodiment, a plurality of pad bases are disposed between the plurality of ink pads and the rubber plate. Further preferably, the extension member is fastened to a base and a second end of the extension member is attached to a handle capable of extending and retracting the extension member; in one preferred embodiment, the handle is a bar that extends beyond each of the side edges of the extension member, and the base comprises at least two grooves sized to receive the bar, a first of the grooves located such that the extension member is retracted when the handle is located within the first groove, and a second of the grooves located such that the extension member is extended when the handle is disposed within the second groove.

In preferred embodiments for this and other aspects of the present invention, the expandable stamp pad comprises a thin, water-impermeable film is disposed between the ink pads when the ink pads are in contact with one another, and/or the ink pads are impregnated with an aqueous-based ink.

In another aspect, the present invention provides a method of stamping comprising the steps of (a) compressing a plurality of ink-impregnated ink pads to provide a substantially continuous stamp pad; (b) contacting a rubber stamp with the substantially continuous stamp pad such that ink is transferred from the substantially continuous stamp pad to the rubber stamp; and (c) separating the plurality of ink pads such that the ink pads do not contact one another. Preferably, the method further comprises repeating steps (a) through (c). In an alternative preferred embodiment, the method further comprises the step of contacting the rubber stamp with an appropriate substrate, such that the ink is transferred to the substrate.

In a further aspect, the present invention provides multicolor stamp pad comprising a plurality of ink pads having a thin, water-impermeable membrane disposed between the ink pads such that water may not flow between adjacent ink pads, and wherein each of the ink pads is impregnated with a differently colored, aqueous-based ink. Further preferably, such stamp pad further comprises means for repetitively compressing and separating the plurality of ink pads such that adjacent ink pads are in contact when compressed and not in contact when separated.

These and other aspects of the present invention will become evident upon reference to the following detailed description and attached drawings.

DETAILED DESCRIPTION OF THE INVENTION

It is desirable to use aqueous dye-based inks in a stamp pad due to certain advantages in manufacture, and due to the versatility that is permitted with such inks. The present invention features a stamp pad suitable for use with a multitude of such aqueous dye-based inks. For example, the stamp pad of the invention permits a user to transfer a continuously inked, multicolor image from a stamp pad comprising a plurality of multicolor aqueous dye-based inks to an appropriate substrate such as paper. The present invention also inhibits dispersion of the aqueous dye-based inks within the stamp pad from one area of the stamp pad to another. The ability to use such plurality of aqueous dye-based inks is effected by the provision of a stamp pad wherein the differently inked pads of the stamp pad are compressed into contact when the stamp pad is in use (via retraction of an extension member) but separated when the stamp pad is not in use (via extension of the extension member). The extension and retraction of the ink pads is preferably used in combination with the application of a flexible thin water-impermeable film, such as a plastic film, on one or both sides of adjacent ink pads that come into contact with each other upon retraction.

The inventive stamp pad may be comprised of any combination of inks, whether water-based or oil-based, dye-colored or pigment colored, or otherwise, provided that the inks of at least two adjacent pads differ in some property (for instance, in an exemplary stamp pad, the inks in all of the ink pads are all be water-based and of a single color, but at least one of the inks is an embossing ink while another, adjacent ink is a conventional marking ink). In a preferred embodiment, the differing inks are all aqueous dye-based inks, and further preferably the inks are each of a different color.

The present invention also features a stamp pad providing continuously inked, multicolor image from a stamp pad comprising a plurality of differing inks wherein the ink pads are separated by a thin flexible water-impermeable film, but wherein the ink pads do not compress and separate.

Figure 1A:
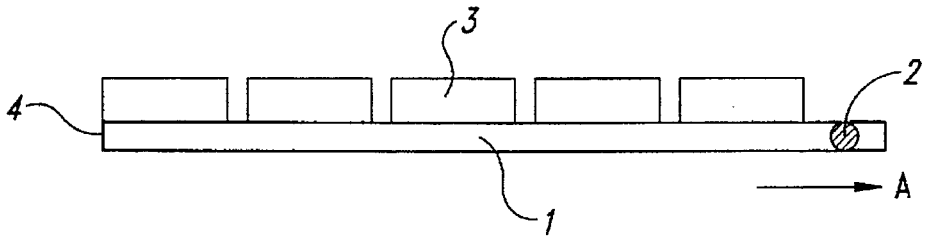
FIG. 1(*a*), FIG. 1(*b*), and FIG. 1(*c*) depict a side view of a stamp pad of the present invention wherein upper view FIG. 1(*a*) depicts the ink pads of the stamp pad in a separated state, middle view FIG. 1(*b*) depicts the ink pads of the stamp pad in contact, and lower view FIG. 1(*c*) depicts the ink pads of the stamp pad in contact, with a thin water-impermeable film disposed between adjacent ink pads.
Figure 1B:
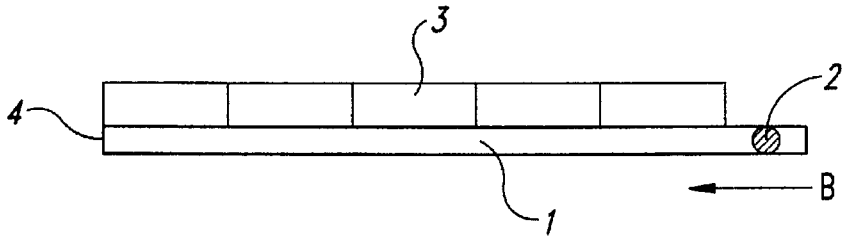
Figure 1C:
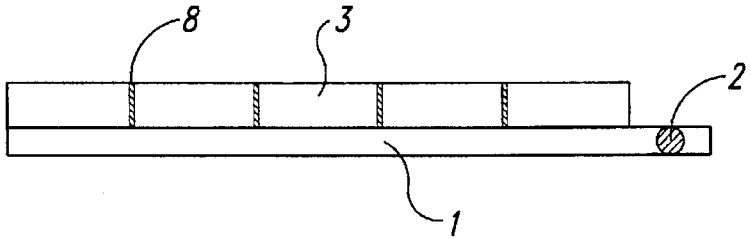

Accordingly, in one aspect the present invention provides a multi-ink stamp pad comprising a number of ink pads, typically each of a different color, arranged in a line upon an extension member that extends and retracts freely and controllably. FIG. 1 depicts one embodiment of the present invention, and illustrates a multi-color stamp pad wherein a plurality of colored ink pads 3 are aligned on an extension member 1 that extends and retracts freely. The ink pads may be made of foam or felt, or other materials capable of absorbing and desorbing an aqueous dye-based ink. Many examples of such ink pads, as well as the other materials utilized in the production of the present invention, are known in the art. Typically, a stationary end 4 of the extension member 1 is fastened in place. An extension lever 2 is attached to the other end of the extension member 1. When not in use, the extension lever 2 is pulled in direction A, as depicted in FIG. 1(*a*), so as to maintain the extension member 1 in a stretched or extended condition. Thus, the multi-colored ink pads 3 are held separate from one another. When in use, the tension on the extension lever 2 is moved in direction B, as depicted in FIG. 1(*b*), causing the extension member 1 to retract. In a preferred embodiment, where the extension member is a rubberized or springy material, the movement in direction B is caused by releasing tension on the extension member 1, thereby allowing extension member 1 to retract. As a result, the ink pads 3 are brought directly into close contact with each other. In an alternative embodiment, as depicted in FIG. 1(*c*), the color ink pads are brought into close contact with one another but are separated by a thin, aqueous dye-based ink impermeable film 8.

Figure 7A:
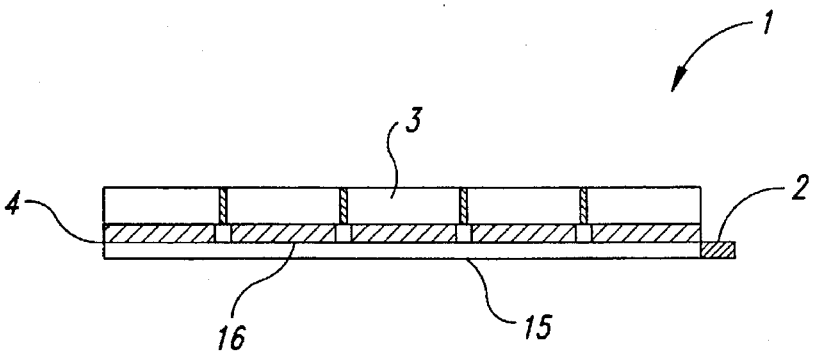
FIG. 7(*a*) and FIG. 7(*b*) depict a side view of a stamp pad according to the present invention wherein the ink pads are disposed upon pad bases which are in turn disposed upon an extension member. In the upper view FIG. 7(*a*) the extension member is retracted; in the lower view FIG. 7(*b*) the extension member is extended.
Figure 7B:
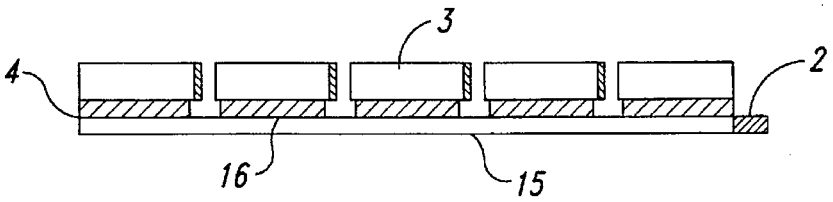

The ink pads 3 may be disposed directly upon the extension member, as in FIG. 1, or the ink pads 3 may be disposed upon a plurality of pad bases 16, which in turn are directly disposed upon the extension member 7, as in FIG. 7. In particular, in FIG. 7, pad bases 16 are disposed upon a rubber plate 15, and the ink pads 3 are disposed upon the pad bases 16.

Figure 2A:
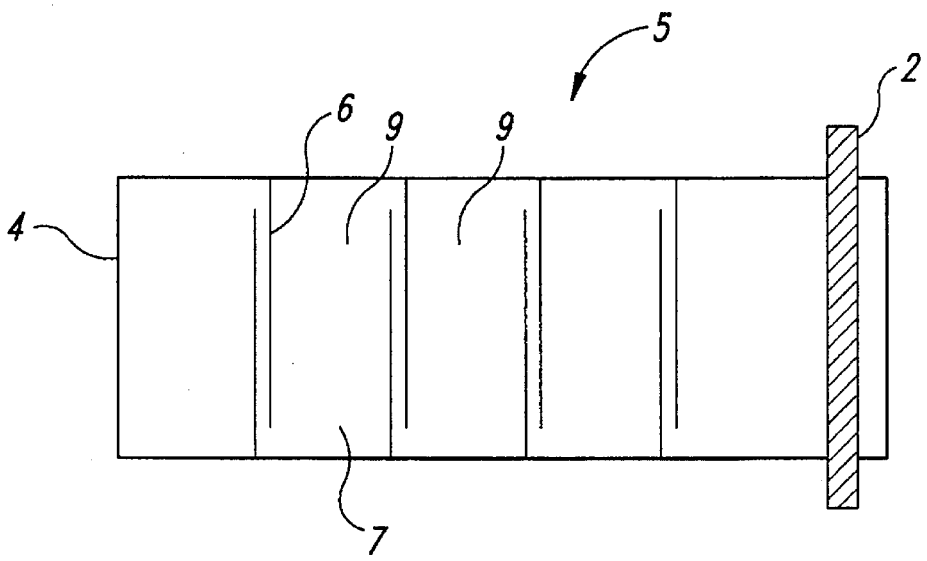
FIG. 2(*a*) and FIG. 2(*b*) depict a top view of an N-shaped spring substrate extension member according to the present invention. In the upper view FIG. 2(*a*) the extension member is retracted; in the lower view FIG. 2(*b*) the extension member is extended.
Figure 2B:
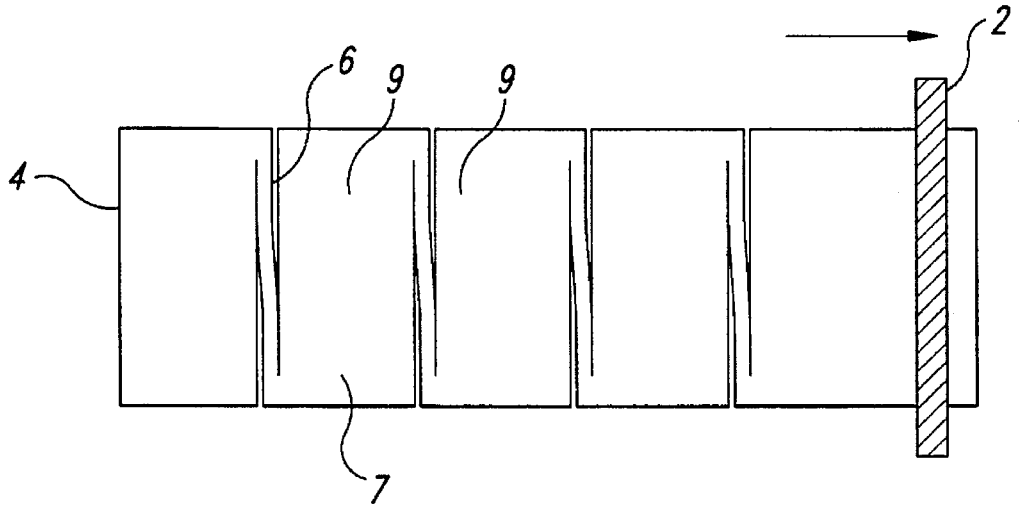

In one embodiment, as depicted in FIG. 2, the extension member 7 is an N-shaped spring substrate 5, typically composed of rubber plate or plastic. The N-shaped spring substrate 5 serves as a flexible unit. One example of such a substrate is depicted in FIG. 2, and is discussed in more detail below. In the N-shaped spring substrate 5, two opposing, non-bisecting, substantially parallel cuts are made in the interstitial areas between ink pad areas 9 in the substrate. The cuts are non-bisecting, which means that the cuts project into the substrate from one side (such as a front or rear side) but do not project across the entire substrate (which would bisect the substrate and cut it into two or more different pieces). The cuts are opposing, which means that the cuts each project into the substrate from opposing sides, such as one cut beginning at the front side and one cut beginning at the rear side. The cuts are substantially parallel to each other, which means that the strip of substrate between the opposing cuts is of substantially uniform width.

An N-shaped spring substrate can be particularly advantageous with respect to manufacturing considerations because it can permit the simultaneous integration of the opposing cuts and the pad areas 9 where the ink pads 3 are to be attached. As with other embodiments of the invention, a thin plastic film may be disposed between the ink pads (see FIG. 1(*c*)).

Preferably, the extension member comprises an elasticized material, or a material that can provide an elasticized function. For example, the extension member can include a plate made of rubber, synthetic rubber or other materials that function in an elastic manner similar to rubber, rubber bands, extensible and retractable fiber strings, a spring such as a copper spring, or a plastic film having compressible areas.

The ink pads may also be extended and retracted by other mechanical means that do not include the "rebound" feature of elasticized materials, as well as other means known in the art.

In another embodiment, the extension member is extended and retracted via a mechanism attached to the lid of the stamp pad. For example, where the extension member is elasticized, the lid of the stamp pad can be hinged to the stamp pad base and include a lever such that opening the lid causes movement of a lever and a release of the tension on the extension member so that the extension member returns to its retracted state, thereby compressing the ink pads located thereon. Conversely, when the lid is closed, the movement of the lid causes extension the extension member to be extended, thereby separating the ink pads. In a related embodiment, where the extension member is not elasticized, the movement of the lid causes mechanical force to extend and then retract the extension member, thereby compressing and then separating the plurality of ink pads.

In accordance with the present invention, it is possible to separate each of the plurality of ink pads in a single operation, the extension of the extension member. In a preferred embodiment, therefore, the ink pads are linked or placed at even intervals on the extension member. Typically, one end of the extension member is fastened in place, further typically upon the base of the stamp pad. The opposite end of the extension member comprises an extension lever such as a handle. The opposite end of the extension member can then be pulled by grasping the handle and pulling it away from the stationary end, to provide an extended extension member. As a result, the extension member is stretched, thereby separating the individual ink pads of the plurality of ink pads at equal intervals. This separation prevents the transfer of aqueous dye-based inks between adjacent ink pads over time, such as when the stamp pad is in storage. Conversely, when the multi-color stamp pad is in use, the extension member is preferably retracted so that the individual colored ink pads are brought into close contact with one another. Thus, the separation of the ink pads during storage prevents inappropriate transfer of the aqueous dye-based inks from one ink pad to another, while the compression of the ink pads during use permits continuous inking of a rubber stamp contacted to the ink pads.

In a preferred embodiment, in addition to the separation and compression of the plurality of ink pads, a flexible, thin film or membrane that is impervious to aqueous dye-based inks is situated between the individual ink pads. This embodiment is particularly advantageous when the multi-color stamp pad is in use for extended periods, or when a user forgets to separate the ink pads after use (in which case the ink pads may be stored in a compressed state). The thin film is typically adhered to at least one contacting side of each of the ink pads, although the thin film may be adhered to both contacting sides of the colored ink pads, if desired.

Thin films suitable for use in the present invention include various plastic films and cellulose films, as well as others known in the art. The film thickness is typically less than 100 μm, and there is preferably no more than 10 μm–30 μm.

The following examples are offered by way of illustration, and not by way of limitation.

EXAMPLES

Example 1

Figure 3:
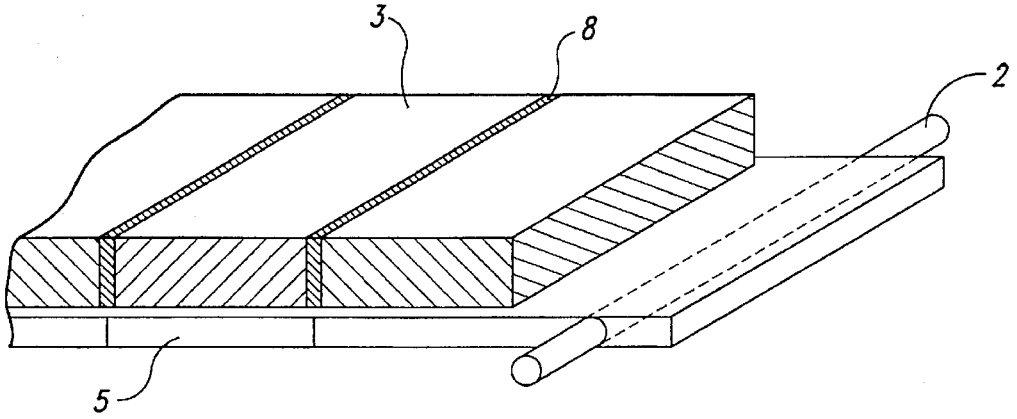
FIG. 3 depicts a perspective view of a portion of a stamp pad according to the present invention wherein individual ink pads are disposed directly upon the N-shaped spring substrate of FIG. 2(*a*) and FIG. 2(*b*).
Figure 4:
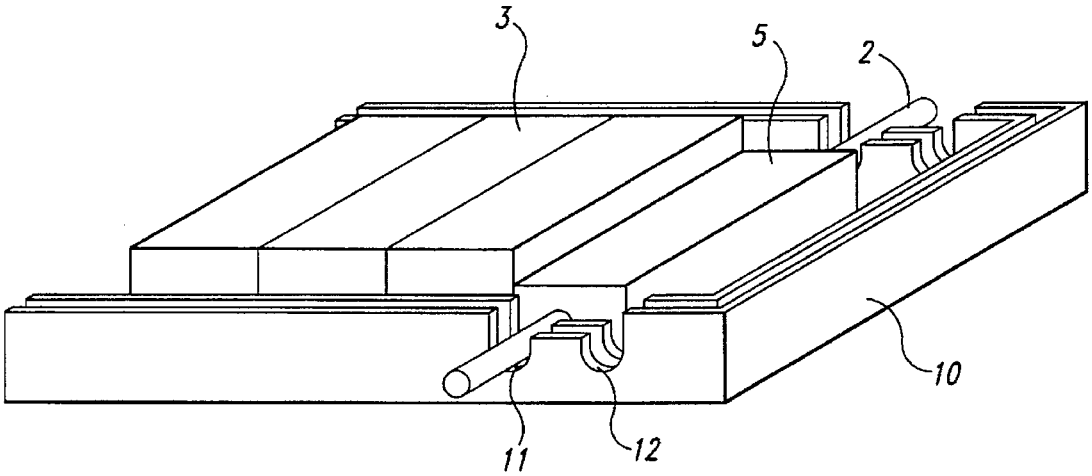
FIG. 4 depicts a perspective view of a stamp pad according to the present invention including an extension member disposed within a base.
Figure 5:
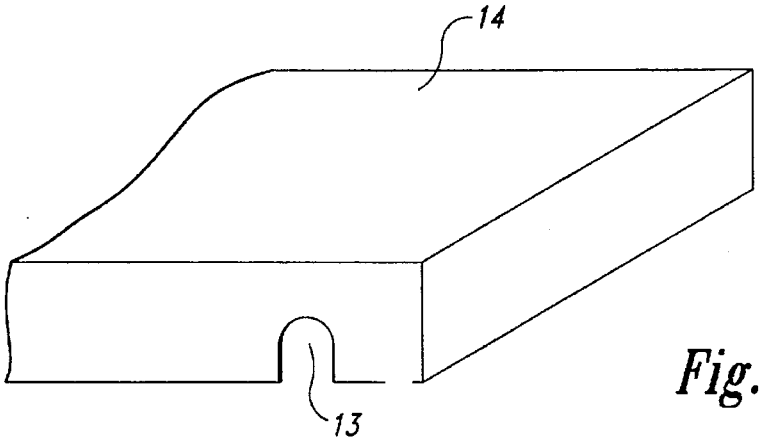
FIG. 5 depicts a perspective view of a lid according to the present invention.
Figure 6:
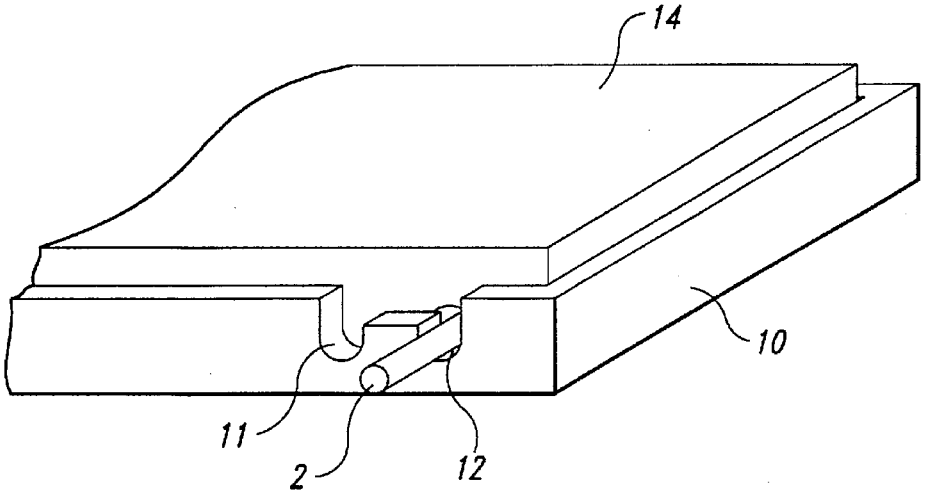
FIG. 6 depicts a perspective view of the lid seated within the base.

A multi-color stamp pad as depicted in FIGS. 2(*a*)–6 was prepared in the manner described below. As noted previously, FIG. 2(*a*) and FIG. 2(*b*) are a top view of an N-shaped spring substrate. FIG. 3 is a perspective view depicting individual ink pads aligned upon an N-shaped spring substrate. FIG. 4 is a perspective view that depicts the N-shaped spring substrate with ink pads mounted in the base of a stamp pad. FIG. 5 is a perspective view of a portion of the lid. FIG. 6 is a perspective view of the lid fitted in the base.

Turning to FIG. 2(*a*) and FIG. 2(*b*), groups of two opposing cuts 6 were formed in four interpad locations between pad areas 9 where the ink pads were adhered on a plastic substrate 7. The plastic substrate 7 consisted of a hard vinyl chloride plate with a length of about 10 cm, a width of about 5 cm and a thickness of about 3 mm. The two opposing cuts comprise a first, non-bisecting cut projecting into the interpad area from a first edge, such as a front edge of the plastic substrate 7, and a second, non-bisecting cut projecting into the interpad area 4 from a second edge, such as a rear edge, of the plastic substrate 7. The cuts are substantially parallel to each other, so that the strip of plastic between the cuts is substantially uniform, and the cuts are non-bisecting, which means that they do not cut the plastic substrate 7 into two different pieces. The plastic substrate 7 has a handle 2 located at one end of the plastic substrate. When the handle 2 is extended, the cuts 6 are stretched into an N-shape. In this manner, the N-shaped spring substrate 5 functions as a spring.

Turning to FIG. 3, a thin film 8 consisting of a polyethylene terephthalate film with a thickness of 30 μm was attached to a felt colored ink pad 3. The thin film 8 had an adhesive coated on the side adhered to the ink pad. The thin film 8 was attached to the side of the ink pad 3 that contacted an adjacent colored ink pad 3. Five colored ink pads 3 were attached to the N-shaped spring substrate 5.

Turning to FIG. 4, the N-shaped spring substrate 5 was inserted in a base 10 of a plastic stamp pad. One end of the N-shaped spring substrate 5 was fastened to the base. The opposite end of the N-shaped spring substrate, including an extension lever 2, i.e., a handle, was disposed toward the end of the base 10 comprising two grooves or notches for locking the extension lever 2. These two grooves were formed in the end of the base and sized to receive the extension lever. The first groove 11 was sized to receive the extension lever 2, and was located such that the extension member was retracted when the extension lever 2 was located within such first groove 11. A second groove 12 was located near the first groove 11, but distal to the fastened end of the N-shaped spring substrate 5. The groove 12 was also sized to receive the extension lever 2. When the extension lever 2 was placed in the second groove 12, the N-shaped spring substrate 5 was extended, and the ink pads were separated.

Next, the individual ink pads 3 were soaked with aqueous dye-based inks and the colors red, orange, yellow, green, and blue. As shown in FIG. 5, lid 14 included a single groove 13 for locking the extension lever 2 at a position where the N-shaped spring substrate 5 was extended was formed in lid 14. The lid groove 13 therefore dictated that the extension lever 2 was placed in the second groove 12 when the lid 14 was in place, such as when the stamp pad was not in use. Accordingly, the ink pads 3 were maintained in a separated state during storage.

The N-shaped spring substrate 5 was stretched to lock the extension lever 2 into the second groove 12, causing all of the colored ink pads 3 to be pulled apart. This resulted in a gap of approximately 2 mm between each of the individual colored ink pads 3. Next, as shown in FIG. 6, the lid was closed and the unit was stored for one month. No transfer of ink was observed. The lid was then opened and the ink pads 3 were brought into close contact with each other and maintained in that condition for one week, although no transfer of ink was observed.

Example 2

A multi-color stamp pad was prepared as described above, except with an extension member structured as shown in FIG. 7(*a*) and FIG. 7(*b*). In particular, a natural rubber plate 15 with a thickness 0.5 mm, a length of 10 cm and a width of 5 cm was set in the base of a stamp pad identical to that used in Example 1. One end of the rubber plate 15 was fastened with rubber paste. Five ink pad bases 16, consisting of hard polyvinyl chloride plates with a thickness of 2 mm, length of 5 cm and width of 1.8 cm were aligned to be parallel to each other in the lengthwise direction on top of the rubber plate 15. These pad bases 16 were adhered with rubber paste at intervals so that the rubber plate would be slightly stretched after fastening the colored ink pads 3 to the pad bases 16. A round acrylic resin bar with a diameter of 2 mm and a length of 6 cm served as the extension lever 2. The extension lever 2 was adhered to the rubber plate 15 opposite the fastened end of the rubber plate 15, and beyond the pad bases 16. The ink pads 3 were fastened to the rubber plate 15. A cellophane paper having a thickness of 40 μm and coated with an adhesive was adhered to the side of the ink pads 3 that touched adjacent ink pads. The ink pads were soaked with aqueous dye-based inks in the colors red, orange, yellow, green, and blue. As in Example 1, an extension lid groove 13 was formed in the lid 14 so as to lock the rubber plate 15 in an extended position via stretching the rubber plate 8 mm.

The rubber plate 15 was stretched to lock the extension lever in the extension groove in the second extension groove of the base, thereby causing the individual ink pads to separate. The gap between the ink pads was approximately 2 mm. Next, as in FIG. 6, the lid was closed and the unit was stored for one month. No transfer of ink was observed. The lid was then opened and the ink pads were brought into close contact with one another and maintained in such position for one week, but no transfer of ink was observed.

Example 3

Figure 8A:
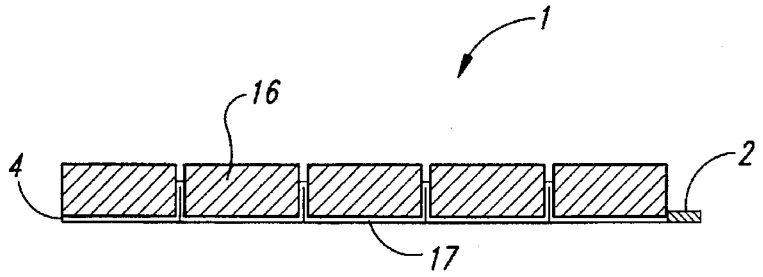
FIG. 8(*a*) and FIG. 8(*b*) depict a side view of an extension member according to the present invention, wherein when the extension member is retracted it folds upwardly into the inter-pad spaces. In the upper view FIG. 8(*a*) the extension member is retracted; in the lower view FIG. 8(*b*) the extension member is extended.
Figure 8B:
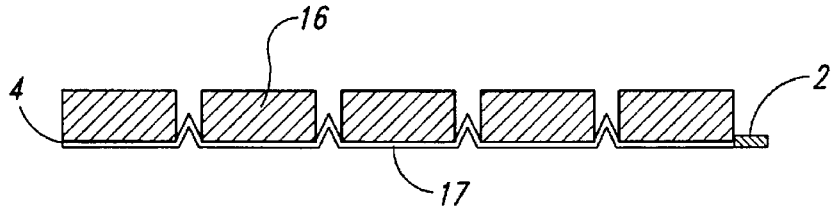

FIG. 8(*a*) and FIG. 8(*b*) are a side, cross-sectional view illustrating another embodiment of the extension member. In particular, the extension member comprises a plastic film 17 linking together a plurality of pad bases 16 on which a plurality of ink pads 3 were situated. A stamp pad was produced as set forth in Example 1, with the exception that the extension member was composed of plastic film 17. As depicted in FIG. 8(*a*), when the extension member was in a retracted state, the plastic film folds up between the pad bases 16, thereby creating a minor distance between the pad bases. Such distance may be exploited to prevent contact of the ink pads 3 even when compressed, if desired. Conversely, the ink pads can be slightly larger than the pad bases so that actual contact between the ink pads is attained during compression of the stamp pad.

The lid was closed and the unit was stored for one month. No transfer of ink was observed. Next, the lid was opened and the colored pads were brought into close contact with each other and maintained in that position for one week, but no transfer of ink was observed.

Example 4

Figure 9:
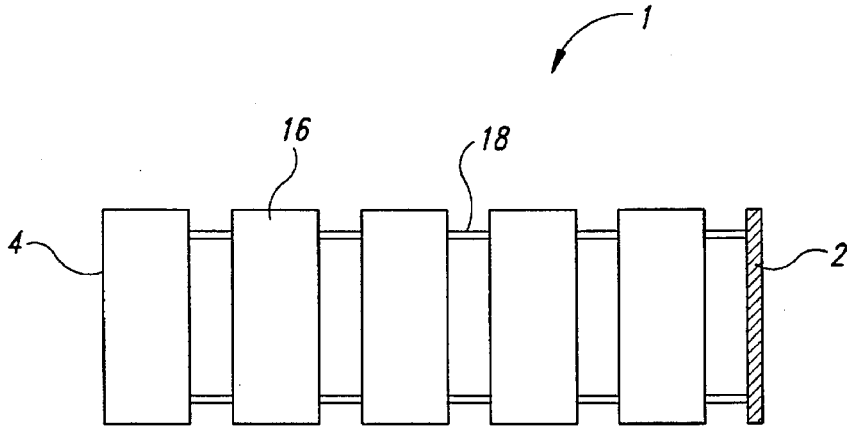
FIG. 9 is a top view of a stamp pad according to the present invention wherein the extension member comprises rubber bands or fiber strings.

FIG. 9 depicts a top view of another embodiment of the extension member. In particular, the extension member comprises a fiber string or rubber band 18 that links together pad bases 16, on which colored ink pads would be situated. A stamp pad was produced in accordance with Example 1 except that the extension member was produced in accordance with extension member depicted in FIG. 9.

The lid was closed and the unit was stored for one month. No transfer of ink was observed. Next, the lid was opened and the colored ink pads were brought under close contact with each other and maintained in that position for one week, but no transfer of ink was observed.

Example 5

Figure 10A:
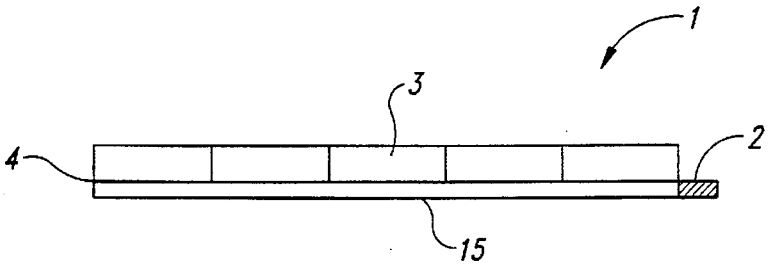
FIG. 10(*a*) and FIG. 10(*b*) depict a side of an N-shaped spring substrate extension member and ink pads of the present invention wherein the ink pads are disposed directly upon the extension member. In the upper view FIG. 10(*a*) the extension member is retracted; in the lower view FIG. 10(*b*) the extension member is extended.
Figure 10B:
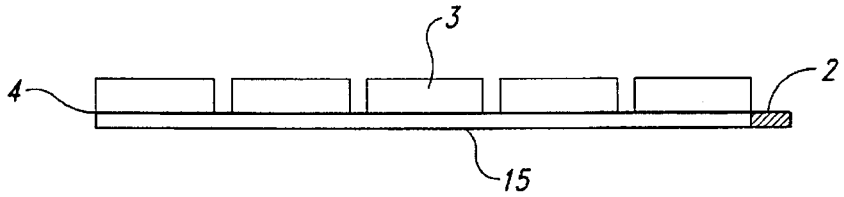
Figure 11:
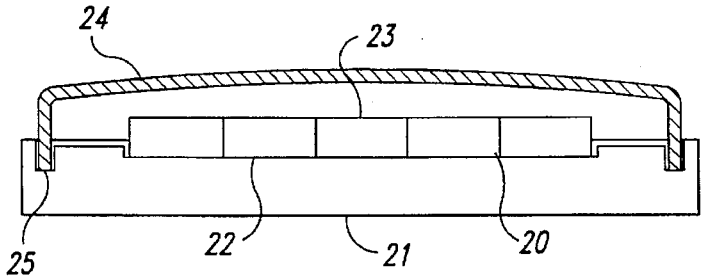
FIG. 11 depicts a side view of a conventional stamp pad wherein the ink pads are maintained in constant contact.
Figure 12:
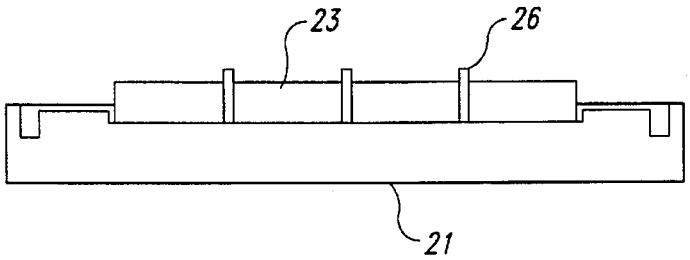
FIG. 12 depicts a side view of a conventional stamp pad wherein the ink pads are separated by plastic partitioning plates.

FIG. 10(*a*) and FIG. 10(*b*) depict a side view of another embodiment of the extension member. In particular, the extension member of FIG. 10 was a rubber plate, essentially the same as that depicted in Example 2 and FIG. 7, except that the ink pads were disposed directly on the rubber plate 15, without using pad bases 16. Other than this difference, the stamp pad was prepared in the same manner as in Example 2.

The lid was closed and the unit was stored for one month. No transfer of ink was observed.

Example 6

A multi-color stamp pad was prepared in the same manner as in Example 1, except that five ink pads were fastened to the N-shaped spring substrate 5 without attaching a thin film consisting of polyethylene terephthalate between the ink pads.

The multi-color pad did not exhibit ink transfer from one ink pad to another when used for short periods of time, but transfer was observed during long periods of use.

Example 7

Figure 13:
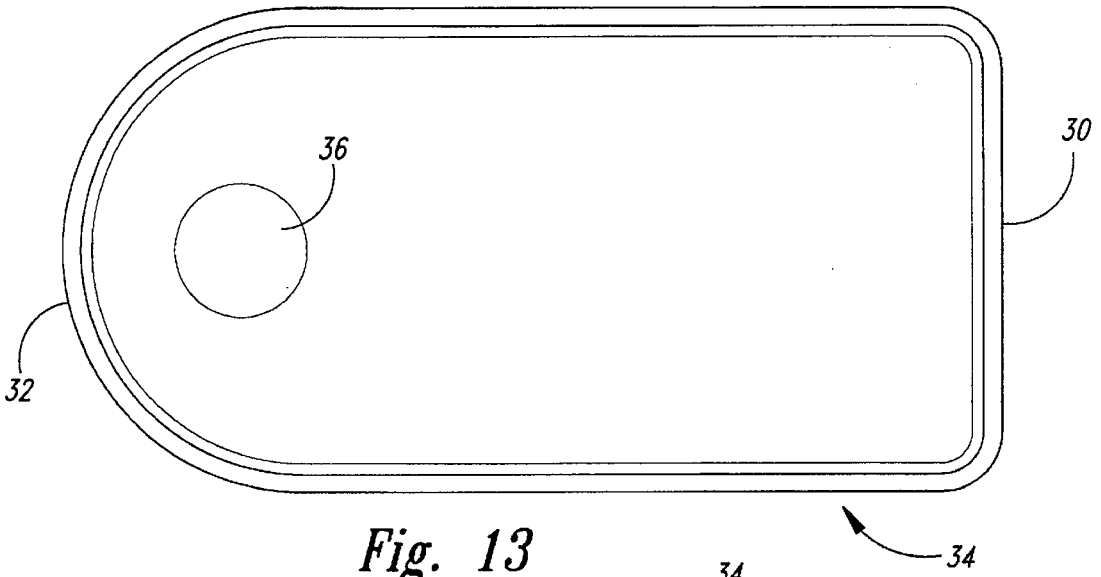
FIG. 13 depicts a top plan view of the lid of an alternative embodiment of the stamp pad.
Figure 14:
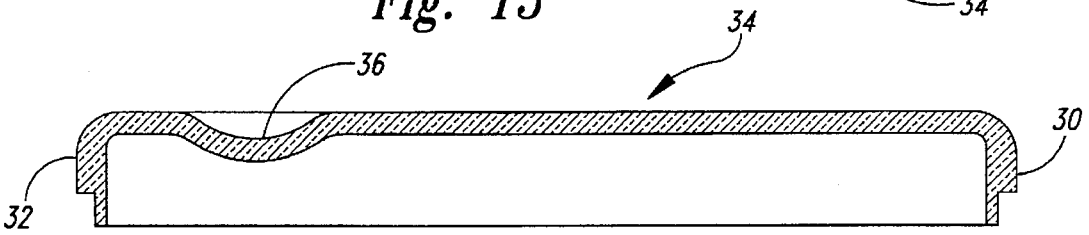
FIG. 14 depicts a side cross-sectional view of the lid of the alternative embodiment of the stamp pad.
Figure 15:
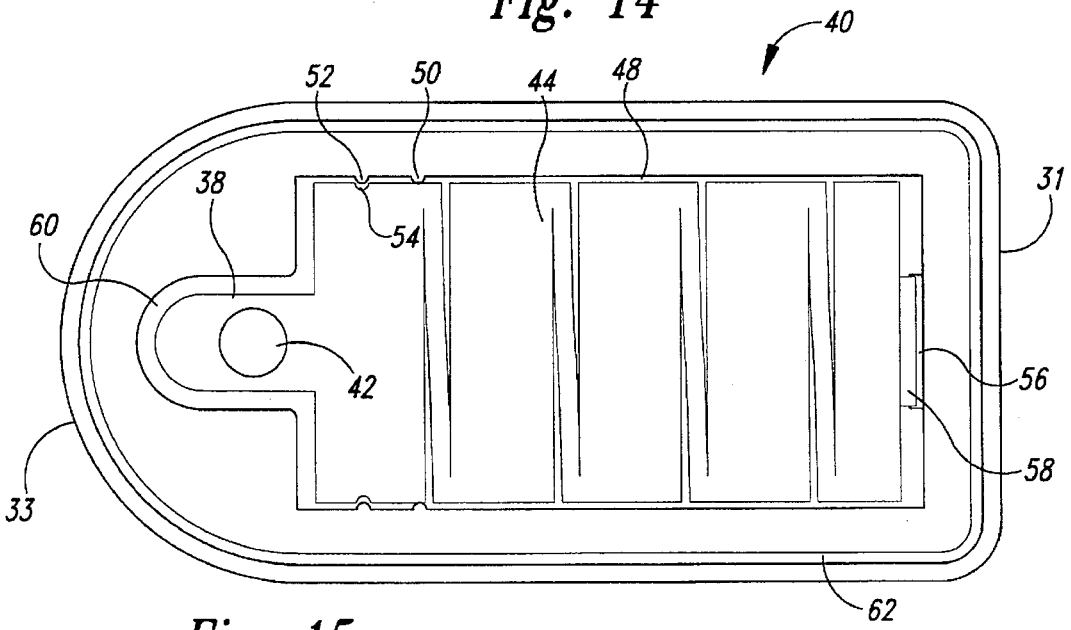
FIG. 15 depicts a top plan view of the base of the alternative embodiment of the stamp pad, with an N-shaped spring substrate disposed therein.
Figure 16:
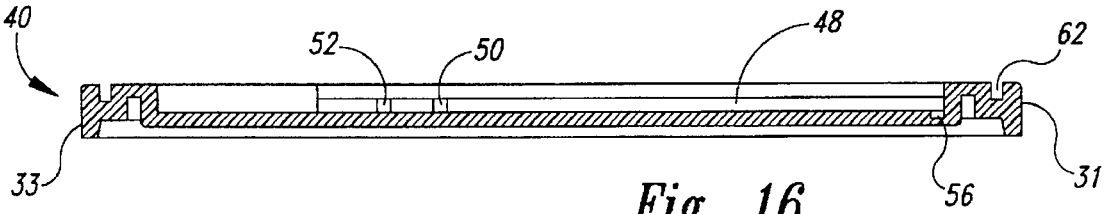
FIG. 16 depicts a side cross sectional view of the base of the alternative embodiment of the stamp pad.

A multi-color stamp pad as depicted in FIGS. 13–16 was prepared in the manner described below. Briefly, as noted above, FIG. 13 depicts a top plan view of the lid of the stamp pad. FIG. 14 depicts a side cross-sectional view of the lid of the stamp pad. FIG. 15 depicts a top plan view of the base of the stamp pad, with an N-shaped spring substrate disposed therein. FIG. 16 depicts a side cross-sectional view of the base of the stamp pad.

Turning to FIG. 13, a stamp pad lid 34 having a straight lid end 30 and a rounded lid end 32 was provided with a depression 36. The depression was centered in the rounded lid end 32 of the stamp pad lid 34. FIG. 14 depicts a cross-sectional side view of stamp pad lid 34, showing the depression 36. Depression 36 is discussed further below in relation to tab 38 of extension member 44 depicted in FIG. 15.

FIG. 15 depicts a stamp pad base 40 sized to fit stamp pad lid 34. As with stamp pad lid 34, stamp pad base 40 has a straight base end 31 and a rounded base end 33. Stamp pad base 40 has a cavity 48 sized to fit an extension member 44. In the embodiment depicted in FIG. 15, the extension member 44 was an N-shaped substrate, similar to that described above in Example 1, although other extension member embodiments, such as those also described above, could be used instead of an N-shaped substrate. The cavity 48 has a cavity extension 60. Extension member 44 includes a tab 38, the extension member 44 and tab 38 sized to fit cavity 48, including cavity extension 60. As can be seen, there was a space between the end of cavity 48 near rounded base end 32 and the adjacent end of extension member 44. In a preferred embodiment, this distance is about 10 mm when measured while extension member 44 is retracted.

On a side of cavity 48 near rounded end 32 are two bumps or projections, retraction bump 50 and extension bump 52. These two bumps were spaced about 8 mm apart. The side of extension member 44 adjacent retraction bump 50 and extension bump 52 has an engagement recess 54, the recess sized to releasably engage retraction bump 50 and extension bump 52. Engagement recess 54 may have a hollow located behind the recess in the extension member 44, which hollow permits engagement recess 54 to flex back and forth in relation to retraction bump 50 and extension bump 52. Accordingly, when tab 38 of extension member 44 was pulled by a user (thereby extending extension member 44), engagement recess 54 was moved to engage extension bump 52, and was retained thereon. Conversely, when tab 38 of extension member 44 was pushed towards the body of cavity 48 (thereby retracting extension member 44), engagement recess 54 engaged retraction bump 50, and was retained thereon. A corresponding set of bumps and engagement recess are preferably located on the opposing side of cavity 48 and extension member 54.

At straight base end 30 of stamp pad base 40, extension member 44 has a fastening protrusion 58, while cavity 48 has a fastening engagement 56. Fastening protrusion 48 was engaged (permanently, if desired) into fastening engagement 56, such that the end of the extension member 44 was retained in place while the opposing end of extension member 44 (including tab 38) was free to extend and retract.

Tab 38 of extension member 44 has a hole 42 therein. Hole 42 is sized to receive depression 36 of stamp pad lid 34.

Hole 42 was located in tab 38 such that when extension member 44 was retracted (e.g., when engagement recess 54 was engaging retraction bump 50), hole 42 was not located beneath depression 36, thereby preventing stamp pad lid 34 from being placed securely upon stamp pad base 40. In other words, depression 36 of stamp pad lid 34 contacts tab 38, and thus the thickness of tab 38 interferes with the seating of stamp pad lid 34 on stamp pad base 40. (I.e., stamp pad lid 34 sat ajar.) Conversely, when extension member 44 was extended (e.g., when engagement recess 54 was engaging extension bump 52), hole 42 was located beneath depression 36, which depression then engaged hole 42, and tab 38 did not interfere with the secure seating of stamp pad lid 34 on stamp pad base 40. Accordingly, stamp pad lid 34 will not fit properly on stamp pad base 40 unless extension member is in an extended position.

FIG. 16 depicts a cross-sectional side view of stamp pad base 40, including extension bump 52, retraction bump 50 and cavity 48. FIG. 16 also depicts a lid groove 62, sized to releasably engage the edge of stamp pad lid 34.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A method of stamping comprising the transfer of ink to a rubber stamp from a plurality of ink-impregnated pads disposed within a base, the method comprising the following steps:

(a) compressing said plurality of ink-impregnated pads toward one another within said base to provide a continuous stamp pad;

(b) contacting said rubber stamp with said plurality of ink-impregnated continuous pads that have been moved toward one another such that ink is transferred from said plurality of ink-impregnated continuous pads to said rubber stamp; and (c) separating said plurality of ink-impregnated continuous pads away from one another within said base to maintain said ink-impregnated pads in a separated state within said base such that said ink pads do not contact one another.

2. The method of claim 1 wherein said method further comprises repeating steps (a) through (c).

3. The method of claim 1 wherein said method further comprises the step of contacting said rubber stamp with an appropriate substrate, such that said ink is transferred to said substrate.

* * * * *

UNITED STATES PATENT AND TRADEMARK OFFICE

CERTIFICATE OF CORRECTION

PATENT NO. : 5,653,804
DATED : August 5, 1997
INVENTOR(S) : Ryo Yasoshima

It is certified that error appears in the above-identified patent and that said Letters Patent is hereby corrected as shown below:

On the title page, please add the following section, --Related U.S. Application Data: Continuation-in-part of Ser. No. 446,205, May 19, 1995.--

On the title page, Foreign Patent Documents section, fifth reference, please delete the reference "4-31288 A 11/1992 Japan" and insert therefor --4-312881 A 11/1992 Japan--.

Signed and Sealed this

Twenty-fifth Day of November, 1997

*Attest:*

Bruce Lehman

BRUCE LEHMAN

*Attesting Officer*

*Commissioner of Patents and Trademarks*